US006308615B1

(12) United States Patent
Takenaka et al.

(10) Patent No.: US 6,308,615 B1
(45) Date of Patent: Oct. 30, 2001

(54) COMPRESSOR

(75) Inventors: Kenji Takenaka; Keiichi Kato; Hajime Kurita; Hirotaka Kurakake, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/519,478

(22) Filed: Mar. 6, 2000

(30) Foreign Application Priority Data

Mar. 8, 1999 (JP) ..... 11-060280

(51) Int. Cl.[7] ..... F04B 27/08

(52) U.S. Cl. ..... 92/129; 92/155; 92/71; 384/2

(58) Field of Search ..... 92/12.2, 57, 71, 92/129, 155; 384/2; 74/60

(56) References Cited

U.S. PATENT DOCUMENTS

| | | | | |
|---|---|---|---|---|
| 1,430,275 | * | 9/1922 | Almen | 74/60 |
| 2,230,839 | * | 2/1941 | Hulsebos | 384/2 |
| 3,125,004 | * | 3/1964 | White | 92/155 |
| 3,181,475 | * | 5/1965 | Thompson | 74/60 X |
| 3,261,216 | * | 7/1966 | Woolfenden | 74/60 |
| 4,420,986 | * | 12/1983 | Nakayama et al. | 74/60 |
| 4,505,187 | * | 3/1985 | Burgio di Aragona | 92/71 X |
| 4,568,252 | | 2/1986 | Hattori et al. | 417/269 |
| 4,868,067 | * | 9/1989 | Fujisawa et al. | 92/155 X |
| 5,056,417 | | 10/1991 | Kato et al. | 92/71 |
| 5,201,261 | * | 4/1993 | Kayukawa et al. | 92/71 |
| 5,293,810 | * | 3/1994 | Kimura et al. | 92/12.2 |
| 5,380,167 | * | 1/1995 | Burkett et al. | 417/269 |
| 5,728,475 | * | 3/1998 | Rateick, Jr. | 428/469 |
| 5,875,702 | * | 3/1999 | Kawagoe et al. | 92/12.2 |
| 5,918,529 | * | 7/1999 | Forster | 92/12.2 |
| 5,943,941 | | 8/1999 | Kato et al. | 92/12.2 |
| 6,189,434 | * | 2/2001 | Kawaguchi et al. | 92/71 |
| 6,192,784 | * | 2/2001 | Kato et al. | 92/71 |

FOREIGN PATENT DOCUMENTS

| | | | |
|---|---|---|---|
| 0 776 986 | 6/1997 | (EP) | C23C/4/08 |
| 0 838 590 | 4/1998 | (EP) | F04B/27/08 |
| 7-146070 | 9/1982 | (JP) . | |
| 60-22080 | 2/1985 | (JP) . | |
| 9-114380 | 5/1985 | (JP) | F04B/25/04 |
| 7-83165 | 3/1995 | (JP) . | |
| 8-247026 | 9/1996 | (JP) . | |
| 10-77968 | 3/1998 | (JP) . | |

* cited by examiner

*Primary Examiner*—John E. Ryznic
(74) *Attorney, Agent, or Firm*—Morgan & Finnegan, LLP

(57) ABSTRACT

A compressor includes a piston and a shoe, which contact and slide on one another. The piston includes a sliding surface, on which a solid lubricant film is formed. The shoe includes a sliding surface that slides on the first sliding surface. A soft film that mainly contains soft metal is formed on the second sliding surface. The solid lubricant that forms the solid lubricant film is a solid lubricant other than a soft metal.

7 Claims, 2 Drawing Sheets

COMPRESSOR

BACKGROUND OF THE INVENTION

The present invention relates to lubrication of moving parts in a compressor. More specifically, the present invention pertains to friction reducing coatings for compressor parts.

To reduce friction between members that form the internal mechanism of a swash plate compressor, various technologies for coating the sliding surfaces of the members have been proposed.

Japanese Unexamined Patent Publication No. 57-146070 describes a double-head-piston-type compressor, the swash plate angle of which is fixed. In the compressor, the spherical surfaces of the shoes for coupling the periphery of the swash plate to the pistons are coated with a lubricant film containing solid lubricant. The coating reduces frictional resistance between the spherical surfaces of the shoes and the corresponding recessed surfaces of the pistons, which reduces power losses.

Japanese Unexamined Patent Publication No. 8-247026 also describes a double-head-piston-type compressor, the swash plate angle of which is fixed. In the compressor, the recessed surfaces of the pistons for receiving the spherical surfaces of the shoes (also known as cam followers) are coated with a film that is mainly made of tin. The tin coating reduces friction between the spherical surfaces of the shoes and the recessed surfaces of the pistons, which prevents damage to the surfaces caused by heat.

These two prior art references relate to fixed swash plate/fixed displacement type compressors, which have fixed swash plate angles. Another type of compressor is known as a variable displacement type. The swash plate of a variable displacement compressor is connected to the drive shaft and is permitted to incline. The swash plate angle $\theta$ (the inclination angle of the swash plate with respect to an imaginary plane P perpendicular to the drive shaft) ranges from a minimum inclination angle $\theta min$ to a maximum inclination angle $\theta max$, which varies the piston stroke and the displacement of the compressor.

In particular, in the field of air-conditioners for vehicles, variable displacement swash plate compressors that vary the displacement in accordance with the cooling load achieve advantages that cannot be achieved by other types of compressors.

In a typical swash plate compressor, the piston stroke (displacement) is determined in accordance with the swash plate diameter (diameter of an imaginary circle that passes through the centers of the piston couplings) and the swash plate angle. The maximum inclination angle, at which the displacement of the compressor is maximized, is determined in consideration of the permissible limit of friction between the swash plate and the shoes and between the shoes and the pistons during the rotation of the drive shaft and the swash plate. In other words, the permissible limit of friction between the sliding members related to the swash plate is the factor that determines the maximum inclination angle. However, in a swash plate compressor, lubricant oil retained in the compressor is atomized by gas (refrigerant gas such as a chlorofluorocarbon) that circulates in the compressor and is carried to the moving parts. Lubrication and friction in the internal mechanism of a compressor are not problematic as long as the compressor is operating normally.

However, in addition, a coating, as in the prior art mentioned previously, is necessary since there are times when the lubrication by atomized oil is not reliable. That is, there may be a temporary shortage of lubricant oil. For example, when the compressor is started after not operating for a long time, the supply of oil may be inadequate. This is because refrigerant gas is liquefied after the compressor is stopped, and the liquefied refrigerant gas washes away lubricant oil from the moving parts. Accordingly, the parts are not lubricated well when the compressor is started. It takes about one minute until lubricant oil is supplied to the moving parts again by oil atomized by refrigerant gas that enters the compressor. During the one-minute period after the compressor starts, the moving parts that need lubrication are not supplied with oil. Certain parts are coated to provide minimum lubrication in this period. In a conventional variable displacement swash plate compressor (the maximum inclination angle of which is around 19 degrees), the problem of limited lubrication has been solved by taking the prior art measures described previously.

However, in recent years, smaller compressors having larger displacements have been required because of the increasing demand for saving energy and space. Accordingly, it is not acceptable to increase the maximum displacement of a compressor by increasing the swash plate diameter and the housing size. Therefore, it is necessary to increase the piston stroke by increasing the maximum inclination angle of the swash plate. It is empirically known that the maximum inclination angle is limited to around nineteen degrees and cannot be increased more than that with only the prior art coating measures described previously. Therefore, there is a need for a better way to reduce the friction between the spherical surfaces of the shoes and the recessed surfaces of the pistons during the first minute of operation.

SUMMARY OF THE INVENTION

An objective of the present invention is to dramatically reduce friction between two compressor parts and to provide a compressor that has a greater displacement without greater outside dimensions. In other words, the objective of the present invention is to provide compressor parts that can operate for a long period without being damaged by friction or friction heat even if the parts are inadequately lubricated by oil.

To achieve the above objective, the present invention provides a compressor having first and second cooperating parts, which include first and second sliding surfaces. The first sliding surface is on the first part. A solid lubricant film is formed on the first sliding surface, and the solid lubricant film includes a solid lubricant other than a soft metal. The second sliding surface is on the second part. The second sliding surface slides on the first sliding surface, and a soft film that mainly contains soft metal is formed on the second sliding surface.

The present invention is preferably applied to a swash plate compressor, and more preferably applied to a variable displacement swash plate compressor that can vary the inclination angle of the swash plate. In any case, the swash plate compressor includes pistons and shoes. The shoes couple the pistons to the periphery of the swash plate. The shoes include spherical sliding surfaces. The pistons include concave sliding surfaces that slide on the spherical surfaces of the shoes.

Solid lubricant films and soft films are preferably formed on the spherical surfaces and the concavities. In this case, it is possible to increase the maximum inclination angle ($\theta max$) and to dramatically increase the displacement of the compressor without increasing its size.

Generally, two mutually sliding members such as the shoes and the pistons (or shoes and swash plate) are made of different metals to prevent seizure caused by friction between the same metals. For example, when the shoes are made of a bearing steel such as a SUJ2 material (high-carbon chromium bearing steel), each piston (or the swash plate) is made of aluminum or aluminum alloy. In this case, the aluminum alloy includes Al—Si alloys and Al—Si—Cu alloys. Materials such as argil alloys that contain hard particles in the matrix are preferred for the pistons. Argil alloys include 10–30 weight percent silicon, and if the ratio of silicon content is below the eutectic composition, the silicon exists as eutectic silicon in the matrix. Other acceptable piston materials that contain hard particles are Al—Mn inter-metal compound, Al—Si—Mn inter-metal compound, Al—Fe—Mn inter-metal compound, and Al—Cr inter-metal compound.

The cooperating parts are not limited to the shoes and the pistons (or the shoes and the swash plate), however, the basic materials for the cooperating parts are preferably the same as those of the prior art shoes and pistons (or shoes and swash plate).

Solid lubricant films are formed on the surface of the first part. The solid lubricant material is a material other than a soft metal. The solid lubricant films are layers made of an organic or inorganic solid lubricant material or resin layers containing an inorganic or organic solid lubricant material. The inorganic solid lubricant material includes molybdenum disulfide, tungsten disulfide, graphite, boron nitride, antimony oxide, and lead oxide. The organic solid lubricant material includes fluororesin such as polytetrafluoroethylene (PTFE). The solid lubricant material is preferably at least one compound selected from the above two groups or a mixture of materials in the above groups. Generally, the solid lubricant materials have a layered or thin-flake structure, and sliding between the layers achieves lubrication.

Some of the solid lubricant materials can be physically or chemically attached to a metal surface. A solid lubricant material may be powdered and dispersed in water, solvent, binder resin, or a mixture of these. Then, the solid lubricant material is applied to the sliding surfaces of the first member and is heated to a certain temperature, which forms the solid lubricant films. In this case, the methods of application include spraying, tumbling, and brushing. The binder resin includes epoxy resin, phenol resin, furan resin, polyamide-imide resin, polyimide resin, polyamide resin, polyacetal resin, fluoro resin (for example, PTFE), and unsaturated polyester resin. When one or a combination of the binder resins is used, the original characteristics of the solid lubricant materials are not lost.

Before forming the solid lubricant films, a foundation treatment may be performed on the sliding surfaces of the first part, and the solid lubricant films are formed on the foundation layers (foundation layers can be omitted). The foundation layers may include films of manganese phosphate, zinc phosphate, chromate salt, and soft nitrided films formed by soft nitriding such as a tuftride method. The foundation layers may be sprayed layers of copper-like alloy or tin-like alloy. Further, when the base metal of the first part is an aluminum-like alloy, the foundation layers may be alumite layers, which are formed by anodizing the base metal.

The thickness of the solid lubricant films (including the foundation layers, if any) is preferably below 10 $\mu$m, more preferably below 7 $\mu$m, and most preferably below 5 $\mu$m. This is to prevent excessive space being formed between the cooperating parts when the thickness of the solid lubricant material varies due to plastic deformation.

A soft film that mainly contains a soft metal is formed on a sliding surface of the second part. The advantage of forming the soft film, which contacts the solid lubricant film formed on the first part, is remarkable but the reason for this is not certain. It is presumed that the soft film fits the solid lubricant film better, which reduces friction between the layers of the solid lubricant material. The fact that sliding between the two members is improved by the combination of the solid lubricant member and the soft film was discovered by the present inventors.

The soft film includes tin (Sn) and tin alloys. The tin alloys are tin alloys with at least one compound selected from the group consisting of copper, nickel, zinc, lead, indium, and silver.

Before forming the soft film, a foundation treatment may be performed on the sliding surface of the second member, and the soft film may be performed on the foundation layer (the foundation layer can be omitted). The foundation treatment includes aluminum anodization treatment, manganese phosphate treatment, zinc phosphate treatment, and zinc plating treatment. Forming the soft film on the foundation layer can improve the adhesion and heat resistance of the soft film.

When an alloy that mainly contains tin is used as a soft metal, the alloy preferably contains at least one compound selected from the group consisting of copper, nickel, zinc, lead, indium. The ratio of the content is more preferably in the range of 0.8–1.2 weight percent in the soft film. The ratio of other metals to tin is varied in accordance with the purpose and performance. For example, the ratio of copper in the soft film is preferably in the range of 0.1 to 50 weight percent. If the ratio of copper is less than 0.1 weight percent, the effect of copper in the soft film is small and the frictional resistance is not improved. If the ratio of copper is greater than 50 weight percent, the effect of tin is reduced, which increases the frictional resistance. The soft film may also include a small amount of solid lubricant material, which can reduce the frictional resistance.

The method for forming the soft film includes widely known electrolytic plating, non-electrolytic chemical plating, CVD method, vacuum evaporation, spattering, and ion plating methods. When the solid lubricant material is dispersed in the soft film, a compound plating may also be used. The thickness of the soft film is preferably in the range of 1–5 $\mu$m. When the thickness is below 1 $\mu$m, the frictional coefficient is not reduced much. When the thickness is greater than 5 $\mu$m, inconveniences such as the separation of the film from the base metal may occur.

The films of the first and second parts cannot be made with the same material, even if it may reduce friction. This is because films of the same material tend to adhere to one another when in contact and sliding on one another, which prevents sliding between the films.

Other aspects and advantages of the present invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

Figure 1:
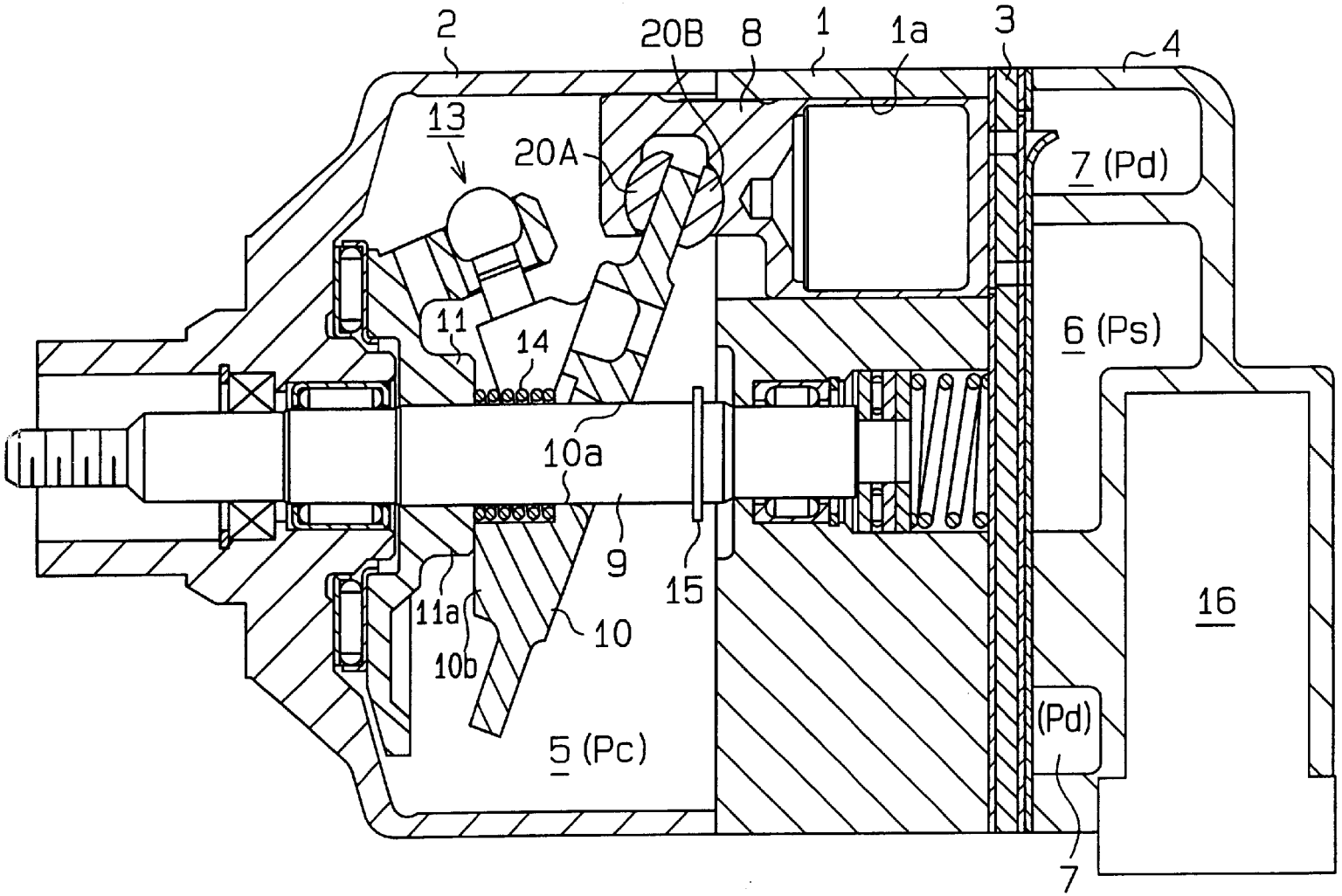
FIG. 1 is a longitudinal cross-sectional view of a variable displacement swash plate compressor.

A variable displacement swash plate compressor according to one embodiment of the present invention will now be described. As shown in FIG. 1, the compressor includes a cylinder block 1, a front housing member 2 coupled to the front of the cylinder block 1, and a rear housing member 4 coupled to the rear of the cylinder block 1 through a valve plate 3, which are fixed to one another by a plurality of through bolts (not shown) to form the compressor housing.

The housing includes a crank chamber 5, a suction chamber 6 and a discharge chamber 7. The cylinder block 1 includes cylinder bores 1*a* (only one shown), and a single-head piston 8 is accommodated in each cylinder bore 1*a*. The suction chamber 6 and the discharge chamber 7 are selectively connected to the cylinder bores 1*a* through various flap valves in the valve plate 3.

A drive shaft 9 is supported in the crank chamber 5. A swash plate 10 is also accommodated in the crank chamber 5. A shaft hole 10*a* is formed in the center of the swash plate 10, and the drive shaft 9 is received in the shaft hole 10*a*. The swash plate 10 is connected to the drive shaft 9 through a hinge mechanism 13 and a lug plate 11 to rotate simultaneously with the drive shaft 9 and to incline with respect to the drive shaft 9. The periphery of the swash plate 10 is coupled to the front end of each piston 8 through a pair of front and rear shoes (cam followers) 20A, 20B, which causes each piston 8 to be driven by the swash plate 10.

When the swash plate 10, which is inclined at a certain angle, rotates with the drive shaft 9, each piston 8 reciprocates in the corresponding cylinder bore 1*a* with a stroke corresponding to the swash plate angle. This draws refrigerant gas from the suction chamber 6 (suction pressure Ps zone), compresses the gas, and discharges the gas to the discharge chamber 7 (discharge pressure Pd zone).

The swash plate 10 is urged toward the cylinder block 1 by a spring 14, that is, the swash plate 10 is urged to reduce its inclination. For example, a snap ring 15, which is fixed on the drive shaft 9, limits the movement of the swash plate 10 in the rearward direction, which limits the minimum inclination angle θmin (three to five degrees, for example) of the swash plate. On the other hand, the maximum inclination angle θmax of the swash plate 10 is limited by, for example, the abutment of a counterweight 10*b* of the swash plate 10 against a limiting portion 11*a* of the lug plate 11.

The inclination angle of the swash plate 10 is determined by the balance of various moments including the moment of rotation based on the centrifugal force during the rotation of the swash plate, the moment of inertia of the piston reciprocation, and the gas pressure moment. The moment of gas pressure is generated by the relationship between the internal pressures of the cylinder bores 1*a* and the internal pressure of the crank chamber 5 (crank pressure Pc). The moment of gas pressure is applied to reduce or to increase the inclination of the swash plate 10 in accordance with the crank pressure Pc. In the compressor of FIG. 1, the moment of gas pressure is varied by adjusting the crank pressure Pc with a control valve 16 (not shown), which places the swash plate 10 at an arbitrary angle between the minimum inclination angle θmin and the maximum inclination angle θmax (See FIGS. 2 and 3). The plane P shown in FIGS. 2 and 3 is an imaginary plain perpendicular to the drive shaft 9.

Figure 2:
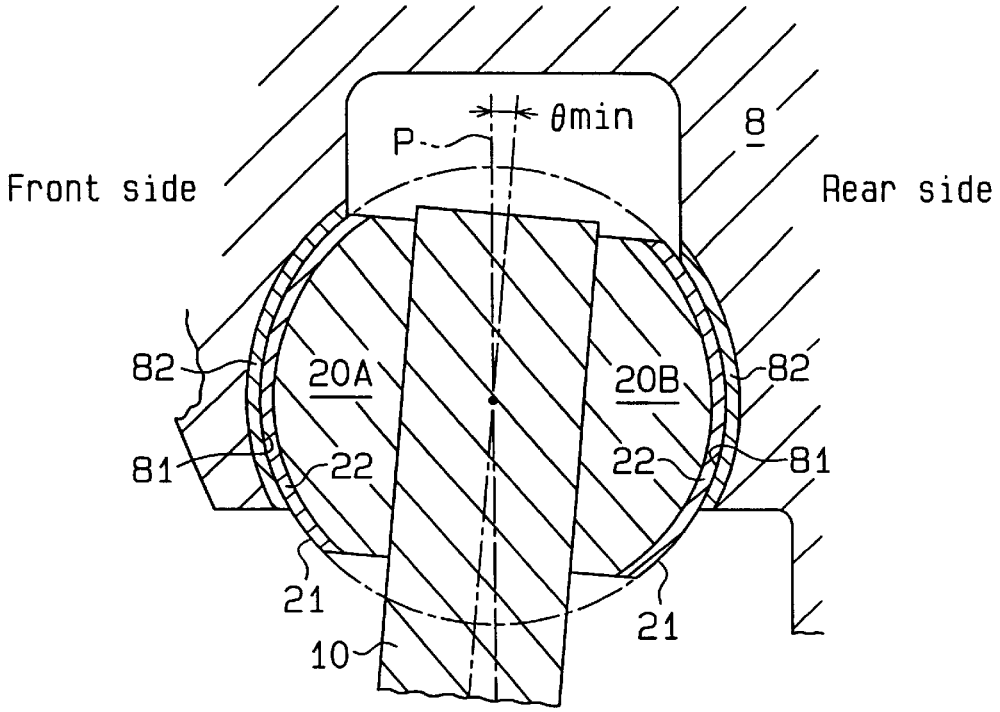
FIG. 2 is a cross-sectional view of the supporting parts between the shoes and the pistons when the swash plate is at the minimum inclination angle.
Figure 3:
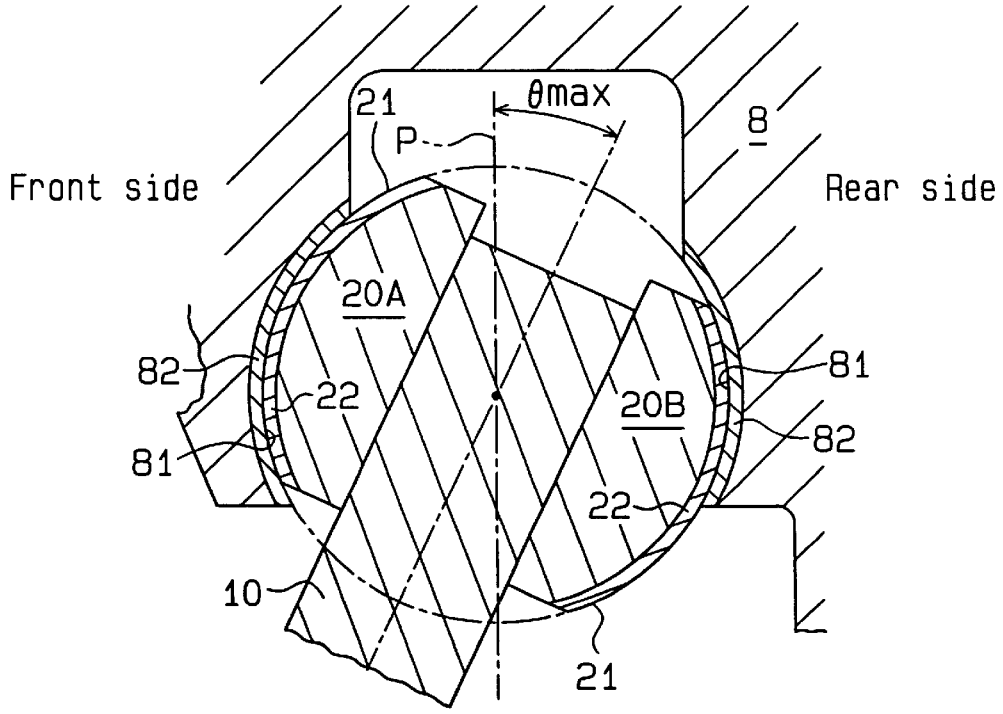
FIG. 3 is a cross-sectional view of the supporting parts between the shoes and the pistons when the swash plate is at the maximum inclination angle.

As shown in FIGS. 2 and 3, a recess for receiving the periphery of the swash plate 10 and the shoes 20A, 20B is formed in the front end of each piston 8. The shoes 20A, 20B include spherical surfaces 21, which serve as sliding surfaces. Concavities 81, which serve as sliding surfaces that contact the spherical surfaces 21, are formed in the recess of each piston 8. The pistons 8 and the swash plate 10 are made of aluminum alloy, and the shoes 20A, 20B are made of bearing steel, which is an iron-like material. Films 22 are formed on the spherical surfaces 21, and films 82 are formed on the concavities 81 of each piston 8. Methods for forming the films 22, 82 are described later in examples 1 and 2.

Generally, sliding resistance, or friction, between the shoes and the pistons increases as the swash plate angle increases. There are two main reasons for this. First, as shown by comparing FIG. 2 with FIG. 3, the stance angle of each shoe 20A, 20B increases as the swash plate angle θ increases, which reduces the contact area (area receiving the compression reaction force) between the spherical surfaces 21 of the shoes 20A, 20B and the concavities 81 of the pistons 8. This increases the pressures applied to the sliding surfaces.

Second, each shoe 20A, 20B is retained between the swash plate 10 and the concavities 81 and receives a horizontal component force, which is a result of the compression reaction force from each piston 8 and the surface resistance force from the swash plate 10. As the swash plate angle increases, the compression reaction force transmitted from each piston 8 to the shoes 20A, 20B increases, which increases the horizontal component force and the pressures applied to the sliding surfaces.

Accordingly, even a small increase in the swash plate angle θ significantly increases the sliding resistance between the shoes 20A, 20B and the pistons 8, at least when the swash plate 10 is located near the maximum inclination angle θmax.

Film forming methods will now be described in examples 1–2 of the present invention and in comparative examples 1–3.

EXAMPLE 1

In the example 1, a solid lubricant film containing molybdenum disulfide was employed as the film 22 on the spherical surfaces 21 of the shoes 20A, 20B. A soft film that mainly contains tin was formed as the film 82 on the concavities 81 of the pistons 8.

The shoes, which are made of bearing steel, were degreased in a 60–70 degree Celsius alkaline solution such as a sodium hydroxide. Then, alkali attached to the surfaces was washed and removed by water. Then, the shoes were immersed in 85–95 degree Celsius manganese phosphate aqueous solution, and manganese phosphate films (about 3 μm in thickness), which serve as foundation layers, were formed on the entire shoe surfaces (including the spherical surfaces 21). After the shoes were washed with hot water and dried by hot air, a phenol resin composition containing a solid lubricant constituent (composed of 20 weight percent molybdenum disulfide, 20 weight percent graphite, and the remaining weight percent phenol resin) was diluted with a solvent, sprayed on the shoes and burned for 30–60 minutes at 150–180 degrees Celsius, which forms solid lubricant films 22 (about 2 μm in thickness) on the foundation layers.

On the other hand, a piston 8, which was made of aluminum alloy, was immersed in a 60–80 degree Celsius non-electrolytic plating aqueous solution (containing six weight percent potassium stannate and 0.012 weight percent copper gluconate) for about three hours and was washed with water. This formed a film 82 (the thickness is about 1.2 μm), which is made of a eutectoid plated layer of tin and copper on the entire surface of the piston 8 (including the concavities 81). The eutectoid plated layer is composed of 97 weight percent tin, three weight percent copper.

EXAMPLE 2

In the example 2, soft films that mainly contain tin were employed as the films 22 on the spherical surfaces 21 of the shoes, and a solid lubricant film that contains molybdenum disulfide was used as the film 82 on the concavities 81 of the pistons.

The shoes, which were made of bearing steel, wore connected to a cathode in an electrolytic plating aqueous solution (containing six weight percent potassium stannate and 0.012 weight percent copper gluconate), and an anode was made of metal shaft that has a high ionization tendency. Tin and copper were deposited on the surfaces of the shoes by applying a predetermined voltage between the electrodes. The film 22, which is made of an eutectoid plated layer of tin and copper, was formed on the entire surfaces of the shoes after washing the shoes with water. The film 22 was whetted and the thickness of the film 22 was made to be about 1.2 μm. The eutectoid plated layer is composed of 97 weight percent tin and three weight percent copper.

On the other hand, the piston 8,which was made of aluminum alloy, was immersed in sulfuric acid or oxalic acid solution, and electrolysis was performed with the piston 8 as an anode. Then, an oxide film (alumite layer) as a foundation layer was formed on the entire surface of the base metal (including the concavities 81). After the oxide film was washed by water and degreased, polyamide-imide resin composition containing molybdenum disulfide was diluted by a solvent, was sprayed on the concavities 81, and was burned at 200 degrees Celsius. This formed a solid lubricant film 82 (about 5 μm in thickness) on the foundation layer.

Comparative Example 1

In comparative example 1, solid lubricant films containing molybdenum disulfide were formed on the spherical surfaces 21 of the shoes as the films 22 as in the example 1. On the other hand, the films 82 were not formed on the concavities 81 of the piston 8, and the original surfaces of the aluminum alloy were exposed.

Comparative Example 2

In comparative example 2, soft films that mainly contain tin were used as the films 82 on the concavities 81 of the piston 8 as in the example 1. On the other hand, the films 22 were not formed on the spherical surfaces 21 of the shoes, and the original surfaces of the bearing steel were exposed.

Comparative Example 3

In comparative example 3, the films 22 were not formed on the spherical surfaces 21 of the shoes, and the original surfaces of the bearing steel were exposed. The films 82 were not formed on the concavities 81 of the piston 8, and the original surfaces of the aluminum were exposed.

Method and Evaluation of Durability Test

The shoes and pistons described in the above examples and comparative examples were employed in the compressor of FIG. 1, and durability tests for continuous sliding between the shoes and the pistons were performed. The tests were performed under the following conditions. The internal mechanism of the compressor was oil-less (no lubricant oil was supplied) to create the conditions immediately after starting the compressor. The suction pressure Ps was 1 kgf/cm$^2$G, the discharge pressure Pd was 15 kgf/cm$^2$G, and the rotation speed of the drive shaft was 1000 rpm. The tests were performed when the swash plate angle was retained at two maximum inclination angles θmax, which were 19 degrees and 23 degrees. In both cases, the compressor was operated for one minute without oil, and any problem such as seizure that was caused between the shoes and the pistons was observed. When there was a problem, an X was written, and when there was no problem, an O was written. Table 1 shows the results.

TABLE 1

| | Films 22 on the shoes | Films 82 on the piston | 19 degrees θ max | 23 degrees θ max |
|---|---|---|---|---|
| Example 1 | $MoS_2$ + C + phenol resin | Mainly Sn | ○ | ○ |
| Example 2 | Mainly Sn | $MoS_2$ + polyamide-imide resin | ○ | ○ |
| Comparative example 1 | $MoS_2$ + C + phenol resin | None | ○ | X |
| Comparative example 2 | None | Mainly Sn | ○ | X |
| Comparative example 3 | None | None | X | X |

As shown in table 1, in the examples 1 and 2, in which the films 22, 82 were formed on both the shoes and the piston, there were no seizures after the compressor was operated for one minute even at the greater maximum swash plate angle (23 degrees θmax). This shows excellent durability. In the comparative examples 1 and 2, in which the films 22 or the films 82 were formed on either shoes or the piston, there were no seizures at the 19 degrees θmax, but there were seizures at the 23 degrees θmax after one minute of operation. In the comparative example 3, in which no films were formed on the shoes and the pistons, seizures occurred at both 19 degrees and 23 degrees θmax.

In this type of compressor, when the maximum inclination angle θmax is increased from 19 degrees to 23 degrees, the displacement dramatically increases 1.23 times, which is tan 23 degrees/tan 19 degrees.

Other Examples

The parts on which the coatings of the present invention are applied are not limited to the shoes and the piston. The present invention may be applied to the following cooperating parts a, b, and c.

a. Between the shoes and the swash plate 10.

b. Between the peripheral surface of the piston 8 and the surface of the cylinder bore 1*a*.

c. Between the drive shaft 9 and the swash plate 10.

The present invention is not limited to the swash plate compressors and may be applied to other types of compressors such as scroll compressors.

It should be apparent to those skilled in the art that the present invention may be embodied in many other specific forms without departing from the spirit or scope of the invention. Therefore, the present examples and embodiments are to be considered as illustrative and not restrictive and the invention is not to be limited to the details given herein, but may be modified within the scope and equivalence of the appended claims.

What is claimed is:

1. A compressor having first and second cooperating parts comprising:

a first sliding surface, which is on the first part, wherein a solid lubricant film is formed on the first sliding surface, and the solid lubricant film includes a solid lubricant other than a soft metal; and a second sliding surface, which is on the second part, wherein the second sliding surface slides on the first sliding surface, and a soft film that mainly contains soft metal is formed on the second sliding surface.

2. The compressor according to claim 1, wherein the compressor is a swash plate compressor, the swash plate compressor including:

a swash plate;

a piston, wherein the piston is the first part, and the piston has a concavity that is included in the first sliding surface;

a shoe, wherein the shoe is the second part, and the shoe couples the periphery of the swash plate to the piston, wherein the shoe has spherical surface that slides on the concavity, and the spherical surface is included in the second sliding surface.

3. The compressor according to claim 2, wherein the swash plate compressor is a variable displacement swash plate compressor, in which the inclination of the swash plate varies.

4. The compressor according to claim 1, wherein the solid lubricant is at least one compound selected from the group consisting of molybdenum disulfide, tungsten disulfide, graphite, boron nitride, antimony oxide, lead oxide, and fluororesin.

5. The compressor according to claim 1, wherein the soft metals include tin or an alloy that contains tin.

6. The compressor according to claim 1, wherein the solid lubricant film includes a binder resin.

7. The compressor according to claim 6, the binder resin is at least one compound selected from the group consisting of epoxy resin, phenol resin, furan resin, polyamide-imide resin, polyimide resin, polyamide resin, polyacetal resin, fluoro resin, and unsaturated-polyester.

* * * * *